US012662999B2

(12) United States Patent
Saponja et al.

(10) Patent No.: US 12,662,999 B2
(45) Date of Patent: Jun. 23, 2026

(54) DOWNHOLE SUCKER ROD PUMP

(71) Applicant: Oilify New-tech Solutions Inc., Invermere (CA)

(72) Inventors: Jeffrey Charles Saponja, Invermere (CA); Robbie Singh Hari, Invermere (CA); Douglas Pipchuk, Invermere (CA); Sean James Peter David, Invermere (CA)

(73) Assignee: Oilify New-tech Solutions Inc., Invermere (CA)

( * ) Notice: Subject to any disclaimer, the term of this patent is extended or adjusted under 35 U.S.C. 154(b) by 0 days.

(21) Appl. No.: 18/464,715

(22) Filed: Sep. 11, 2023

(65) Prior Publication Data

US 2024/0110561 A1 Apr. 4, 2024

Related U.S. Application Data

(60) Provisional application No. 63/405,242, filed on Sep. 9, 2022.

(51) Int. Cl.
*F04B 47/00* (2006.01)
*F04B 53/12* (2006.01)

(52) U.S. Cl.
CPC ..... *F04B 47/00* (2013.01); *F04B 53/125* (2013.01)

(58) Field of Classification Search
CPC ..... F04B 47/00; F04B 53/125; F04B 53/12
See application file for complete search history.

(56) References Cited

U.S. PATENT DOCUMENTS 2,074,591 A * 3/1937 Rood ..... F04B 53/14 277/412
3,801,235 A 4/1974 Douglas
(Continued)

FOREIGN PATENT DOCUMENTS

RU 2735124 C1 10/2020

OTHER PUBLICATIONS

Slides for "Major Design Flaw", published on https://www.slideshare.net on Sep. 24, 2015, based on submission by Garold Muth. (Year: 2015).*

(Continued)

*Primary Examiner* — Bryan M Lettman
(74) *Attorney, Agent, or Firm* — Smart & Biggar LP

(57) ABSTRACT

A downhole sucker rod pump comprising: a plunger, a housing including an inner surface, a housing passage defined by the inner surface, and a recess defined within the inner surface of the housing. The plunger and the housing are co-operatively configured such that the plunger is operable for reciprocating movement through the housing passage, with effect that: the plunger traverses a plunger-traversable section of the inner surface of the housing, and solids-comprising reservoir fluid material is displaceable in an uphole direction via the housing passage. At least a portion of the recess is a plunger-traversable recess, and the plunger-traversable recess portion is defined within the plunger-traversable section, the housing passage includes a downhole space disposed downhole relative to the plunger-traversable section, and the plunger-traversable recess portion is disposed in flow communication with the downhole space.

21 Claims, 10 Drawing Sheets

(56) References Cited

U.S. PATENT DOCUMENTS

| | | | | |
|---|---|---|---|---|
| 3,861,471 | A * | 1/1975 | Douglas | E21B 43/38 166/112 |
| 5,725,365 | A * | 3/1998 | Solomon | F04B 53/125 417/552 |
| 6,290,475 | B1 * | 9/2001 | Snow | F04B 53/14 417/430 |
| 2010/0108150 | A1 | 5/2010 | Ford | |
| 2014/0044567 | A1 * | 2/2014 | Bauck | F16N 11/10 417/292 |

OTHER PUBLICATIONS

2021 International Sucker Rod Pumping Virtual Workshop; Feb. 8-12, 2021; Use Dynamometer Data to Identify Solids Impacting Pump Operation; O. Lynn Rowlan.

Volodymyr Dzyura; Modeling of Partially Regular Microreliefs Formed on the End Faces of Rotation Bodies by a Vibration Method; Ukrainian Journal of Mechanical Engineering and Materials Science; vol. 6, No. 1, 2020; pp. 31-38.

Slides for "Major Design Flaw", published on https://www.slideshare.net on Sep. 24, 2015, based on submission by Garold Muth.

* cited by examiner

DOWNHOLE SUCKER ROD PUMP

CROSS-REFERENCE TO RELATED APPLICATION

This application claims the benefits of priority to U.S. Provisional Patent Application No. 63/405,242, filed Sep. 9, 2022, titled DOWNHOLE SUCKER ROD PUMP, the contents of which are hereby expressly incorporated into the present application by reference in their entirety.

FIELD

The present disclosure relates to removing solid material from reservoir fluids in a downhole pump operation during hydrocarbon production.

BACKGROUND

Subterranean wells are used to pump fluids contained in an oil reservoir to the surface of the well. These reservoir fluids are primarily composed of liquid and gaseous materials, but inevitably, as the fluids sit in the reservoir and as they are pumped through the well to the surface, solid material will accumulate in the reservoir fluids. This solid material, for example sand, is not a desired product of the subterranean well production and it is desirable to remove the solid material from the fluid reservoir before it reaches the well surface, in order to mitigate issues down the line during processing of the reservoir fluids.

Downhole pumps often include a plunger and barrel apparatus in order to pump the reservoir fluids to the surface. The barrel is a cylindrical passage in which the plunger reciprocates. There is a clearance between the barrel and the plunger in order to allow the reservoir fluids to provide a fluid seal around the plunger. As the plunger reciprocates in the barrel, the plunger applies kinetic energy to the reservoir fluids and the reservoir fluids are pumped upwards.

The clearance between the plunger and barrel is beneficial for pump operation, but also results in damage to pump components, especially the plunger, due to the accumulated solid material. In particular, solid material can accumulate within this clearance, between the barrel and the plunger. As the plunger reciprocates, this solid material accumulates in between the plunger and barrel and causing grooving in the plunger. Over time, this grooving becomes deeper and results in lost efficiency in the pump. Ultimately, the pump can fail if the grooving becomes too extensive. Accordingly, there is a need for an improved plunger and barrel apparatus for a downhole pump that mitigates the damages caused by accumulated solid materials.

SUMMARY

In one aspect, there is provided a downhole sucker rod pump comprising: a plunger, a housing including an inner surface, a housing passage defined by the inner surface, and a recess defined within the inner surface of the housing. The plunger and the housing are co-operatively configured such that the plunger is operable for reciprocating movement through the housing passage, with effect that: the plunger traverses a plunger-traversable section of the inner surface of the housing, and solids-comprising reservoir fluid material is displaceable in an uphole direction via the housing passage. At least a portion of the recess is a plunger-traversable recess, and the plunger-traversable recess portion is defined within the plunger-traversable section, the housing passage includes a downhole space disposed downhole relative to the plunger-traversable section, and the plunger-traversable recess portion is disposed in flow communication with the downhole space.

In another aspect, there is provided a downhole rod pump comprising: a plunger, a housing including an inner surface, and a plurality of helical grooves defined within the inner surface of the housing, each one of the plurality of helical grooves, independently, winding in the same rotational direction. The plunger and the housing are co-operatively configured such that the plunger is operable for reciprocating movement through the housing, with effect that the plunger traverses a plunger-traversable section of the inner surface of the housing. At least a portion of the plurality of helical grooves are plunger-traversable grooves, and the plunger-traversable grooves are defined within the plunger-traversable section.

In another aspect, there is provided a downhole rod pump comprising: a plunger; a housing including an inner surface; and a recess defined within the inner surface of the housing, for conveying solids-comprising reservoir fluid material; wherein: the plunger and the housing are co-operatively configured such that: the plunger is operable for reciprocating movement through the housing between an uppermost position and a lowermost position, with effect that a the plunger traverses a plunger-traversable section of the inner surface of the housing; and throughout the reciprocating motion, a clearance is established between the plunger and the housing; the recess and the plunger are co-operatively configured such that, while the plunger is emplaced at the uppermost position, the recess is disposed in flow communication with a space above the plunger and extends downwardly to a space below the plunger; and the flow communication between the recess and the space above the plunger is established in the absence of flow communication via the clearance.

BRIEF DESCRIPTION OF THE DRAWINGS

Reference will now be made, by way of example, to the accompanying drawings which show example embodiments, and in which.

Similar reference numerals may have been used in different figures to denote similar components.

DETAILED DESCRIPTION

Figure 1A:
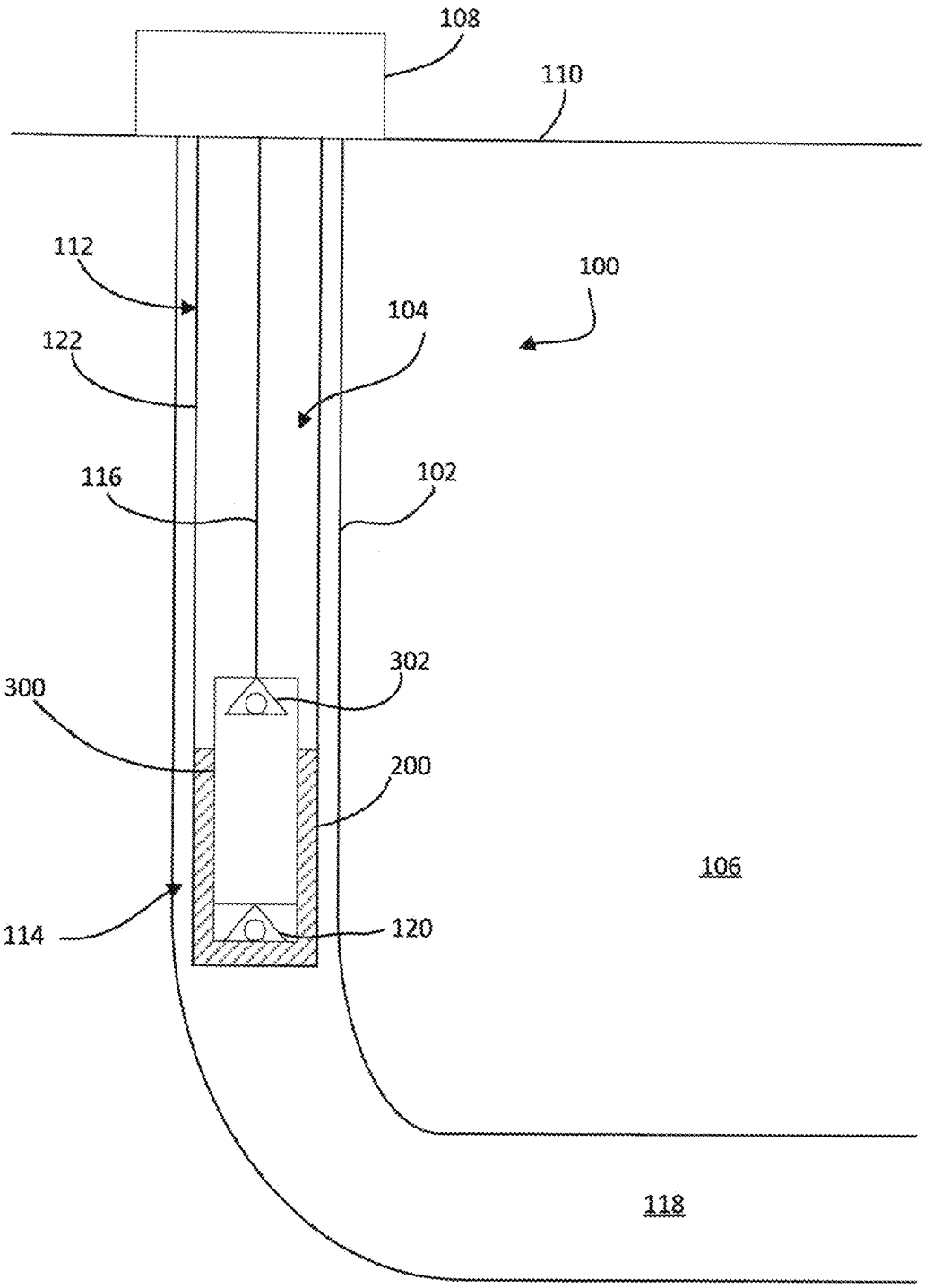
FIG. 1*a* is a schematic illustration of an embodiment of a downhole sucker rod pump system with a tubing pump.
Figure 1B:
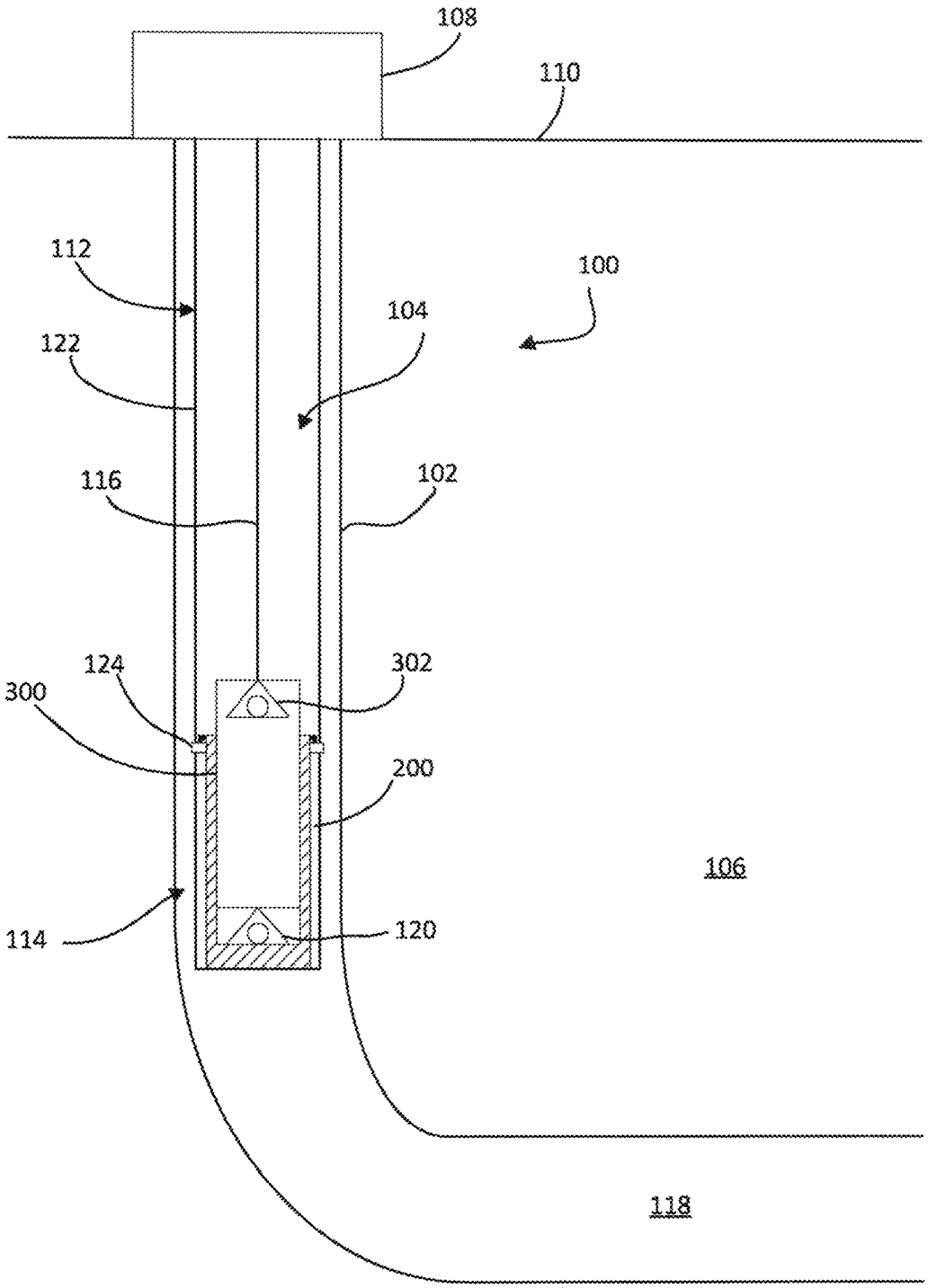
FIG. 1*b* is a schematic illustration of an embodiment of a downhole sucker rod pump system with an insert pump.

FIGS. 1*a* and 1*b* depict a schematic illustration of a downhole pumping system 100. A wellbore 102 of a subterranean formation can be straight, curved or branched. The wellbore can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. In some embodiments, for example, the central longitudinal axis of the passage of a horizontal section is disposed along an axis that is between about 70 and about 110 degrees relative to the vertical, while the central longitudinal axis of the passage of a vertical section is disposed along an axis that is less than about 20 degrees from the vertical "V", and a transition section is disposed between the horizontal and vertical sections.

"Reservoir fluid" is fluid that is contained within an oil reservoir. Reservoir fluid can be liquid material, gaseous material, or a mixture of liquid material and gaseous material. The reservoir fluid includes hydrocarbon material, such as oil, natural gas condensates, or any combination thereof. The reservoir fluid can also contain water. The reservoir fluid can also include fluids injected into the reservoir for effecting stimulation of resident fluids within the reservoir.

Although reservoir fluid is primarily comprised of liquid and gaseous material, it is inevitable that solid material will accumulate in the reservoir fluid, as the reservoir fluid is pumped to the surface of the well. This solid material can be in the form of solid particulates, such as sand. It is preferable to remove the solid material from the reservoir fluids before pumping it to the surface, as solid material can impact the processing of the reservoir fluids after they have been pumped to the surface.

A wellbore string 104 is emplaced within the wellbore 102 for stabilizing the subterranean formation 106. In some embodiments, for example, the wellbore string 104 also contributes to effecting fluidic isolation of one zone within the subterranean formation 106 from another zone within the subterranean formation 106.

The fluid productive portion of the wellbore 102 may be completed either as a cased-hole completion or an open-hole completion.

With respect to a cased-hole completion, in some embodiments, for example, a wellbore string 104, in the form of a wellbore casing that includes one or more casing strings, each of which is positioned within the wellbore 102, having one end extending from the wellhead 108, is provided. In some embodiments, for example, each casing string is defined by jointed segments of pipe. The jointed segments of pipe typically have threaded connections.

Typically, a wellbore 102 contains multiple intervals of concentric casing strings, successively deployed within the previously run casing (not depicted in the Figures). With the exception of a liner string, casing strings typically run back up to the surface 110. Typically, casing string sizes are intentionally minimized to minimize costs during well construction. Smaller casing sizes make production and artificial lifting more challenging.

For wells that are used for producing reservoir fluid, few of these actually produce through the wellbore casing. This is because producing fluids can corrode steel or form undesirable deposits (for example, scales, asphaltenes or paraffin waxes) and the larger diameter can make flow unstable. In this respect, a production string 122 is usually installed inside the last casing string. The production string 122 is comprised of tubing and acts as the primary conduit through which reservoir fluids are produced to the surface 110. The production string 122 is provided to conduct reservoir fluid, received within the wellbore, to the wellhead 108. The production string 122, in addition to providing the conduit for reservoir fluid production, also helps to protect primary wellbore components, including the casing and the liner, from environmental impacts, such as corrosion or erosion by the reservoir fluid. In some embodiments, for example, the annular region between the last casing string and the production string 122 may be sealed at the bottom by a packer.

The wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 106. When disposed in flow communication with the subterranean formation 106, the wellbore 102 is disposed for receiving reservoir fluid flow from the subterranean formation 106, with effect that the system 100 receives the reservoir fluid.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 108. Cement may be provided within the annular region between the liner string and the oil reservoir for effecting zonal isolation (see below), but is not in all cases. In some embodiments, for example, this liner is perforated to effect flow communication between the reservoir and the wellbore. In some embodiments, for example, the production tubing string may be engaged or stung into the liner string, thereby providing a fluid passage for conducting the produced reservoir fluid to the wellhead 108.

An open-hole completion is established by drilling down to the producing formation, and then lining the wellbore (such as, for example, with a wellbore string 104). The wellbore 102 is then drilled through the producing formation, and the bottom of the wellbore 102 is left open (i.e. uncased), to effect flow communication between the reservoir and the wellbore.

The system 100 receives, via the wellbore 102, the reservoir fluid flow from the subterranean formation 106. As discussed above, the wellbore 102 is disposed in flow communication (such as through perforations provided within the installed casing or liner, or by virtue of the open hole configuration of the completion), or is selectively manipulated into flow communication (such as by perforating the installed casing, or by actuating a valve to effect opening of a port), with the subterranean formation 106. When disposed in flow communication with the subterranean formation 106, the wellbore 102 is disposed for receiving reservoir fluid flow from the subterranean formation 106, with effect that the system 100 receives the reservoir fluid.

In some embodiments, for example, the system 100 includes a production string 122, including a reservoir production assembly 112, disposed within the wellbore string 104. The reservoir production assembly 112 includes a pump 114.

In some embodiments, for example, the pump 114 is a rod pump 114. The rod pump 114 includes a plunger 300, attached to a rod 116 or a rod string 116, and connected to surface equipment which causes reciprocating movement of the plunger 300. In some embodiments, for example, the surface equipment includes a prime mover (e.g. an internal combustion engine or a motor), a crank arm, and a beam. The prime mover rotates the crank arm, and the rotational movement of the crank arm is converted to reciprocal longitudinal movement through the beam. In some embodiments, for example, the prime mover is a pumpjack. The beam is attached to a polished rod by cables hung from a horsehead at the end of the beam. The polished rod passes through a stuffing box and is attached to the plunger 300. Accordingly, the surface equipment effects reciprocating longitudinal movement of the plunger 300, and further defines the upper and lower displacement limits of the plunger 300. Reservoir fluid is produced to the surface 110 in response to reciprocating longitudinal movement of the rod by the pumpjack. The plunger 300 reciprocates longitudinally within the reservoir production assembly 112, and, in particular, within the housing 200. In some embodiments, for example, the plunger 300 is cylindrical in shape.

In some embodiments, for example, the pump 114 is a tubing pump with the housing 200 being formed as a part of the production string 122, as depicted in FIG. 1A. When the pump 114 is a tubing pump, the pump 114 is coupled to the production string 122 such that the housing 200 acts as a section of the production string 122. In other embodiments, the pump 114 is an insert pump, with the housing 200 being landed on a landing site, or anchored to the tubing, as depicted in FIG. 1B. When the pump 114 is an insert pump, the pump 114 is inserted into the tubing in the production string 122 and run as an assembled unit with the sucker rod 116. The insert pump is anchored to the production string 122, for example, in a cup type or mechanical type seating nipple 124, which is run as part of the production string 122. The insert pump can be anchored at the top of the pump 114, as depicted in FIG. 1B or at the bottom of the pump 114. An insert pump is typically smaller in diameter than a tubing pump, as depicted in FIG. 1B, in order to be inserted into the production string 122, allowing the production string 122 to extend downhole past the pump 114.

A reservoir fluid-receiving zone 118 is disposed within the wellbore string 104 for receiving reservoir fluid flow that is conducted from the subterranean formation 106 and into the wellbore 102. In this respect, reservoir fluid flow, from the subterranean formation 106, is received by the reservoir fluid-receiving zone 118. In some embodiments, for example, the reservoir fluid-receiving zone 118 is disposed within a horizontal section of the wellbore 102.

The reservoir fluid-receiving zone 118 is in fluid communication with the reservoir production assembly 112 such that the reservoir fluid can be pumped uphole using the plunger 300. The reservoir production assembly 112 includes a standing valve 120 (for example, at a bottom end of the reservoir production assembly 112). The standing valve 120 is configured to co-operate with the reservoir fluid-receiving zone 118 such that, while the standing valve 120 is open, flow communication is established between the pump cavity 114A and the reservoir fluid-receiving zone 118, and while the standing valve 120 is closed, flow communication between the pump cavity 114A and the reservoir fluid-receiving zone 118 is sealed, such that the reservoir fluid disposed within the pump cavity 114A is prevented from flowing back into the reservoir fluid-receiving zone 118.

The wellhead 108 is also in fluid communication with the reservoir production assembly 112 such that the reservoir fluid, received within the reservoir fluid-receiving zone 118, and being pumped uphole, can be pumped uphole to the surface 110 via the wellhead 108. The reservoir fluid production assembly 112 includes a travelling valve 302. The travelling valve 302 is configured to co-operate with pump cavity 114A such that, while the travelling valve 302 is open, flow communication is established between the pump cavity 114A and the wellhead 108, and while the travelling valve 302 is closed, flow communication between the pump cavity 114A and the wellhead 108 is sealed. In this respect, in some embodiments, for example, the pump cavity 114A is disposed between the standing valve 120 and the travelling valve 302. In some embodiments, for example, the travelling valve 302 is displaced with (such as, for example, translates with) the plunger 300.

In some embodiments, for example, the pump 114 includes a barrel that defines a pump chamber. The pump chamber provides the space within which the plunger 300 reciprocates. By reciprocating within the pump chamber, the pressure inside the pump chamber will vary and have an effect on the open or closed configuration of the travelling valve 302 and the standing valve 120. In some embodiments, for example, the housing 200 functions as the working barrel for the pump 114, wherein the reciprocating movement of the plunger can remain within the housing 200 and spans a plunger-traversable section 212 of the housing 200. The reciprocating movement of the plunger 300 can create harsh downhole conditions, for example, increased forces due to pressure and friction. Such conditions are necessary in order to provide the pumping forces required to pump reservoir fluid to the surface 110, and also necessitate a housing 200, which can be designed specifically to withstand the conditions caused by the plunger 300, for example, by being made of stronger materials, or by being more easily removable or accessible for maintenance.

During the upstroke of the plunger 300, the travelling valve 302 is closed and the standing valve 120 is open. This allows reservoir fluid to enter into the reservoir production assembly 112 and the reservoir fluid located in an upper space 208 above the plunger 300 is lifted to the surface by the plunger 300. On the downstroke of the plunger 300, the travelling valve 302 is open and the standing valve 120 is closed. This ensures that fluid remaining within the reservoir production assembly 112 above the travelling valve 302 does not flow downwards through the plunger 300 back into the pump cavity 114A, and subsequently into the reservoir fluid-receiving zone 118, while also enabling the reservoir fluids displaced by the plunger 300, to be lifted towards the surface 110 on the subsequent upstroke. In some embodiments, for example, the travelling valve 302 and the standing valve 120 are ball valves.

Figure 1C:
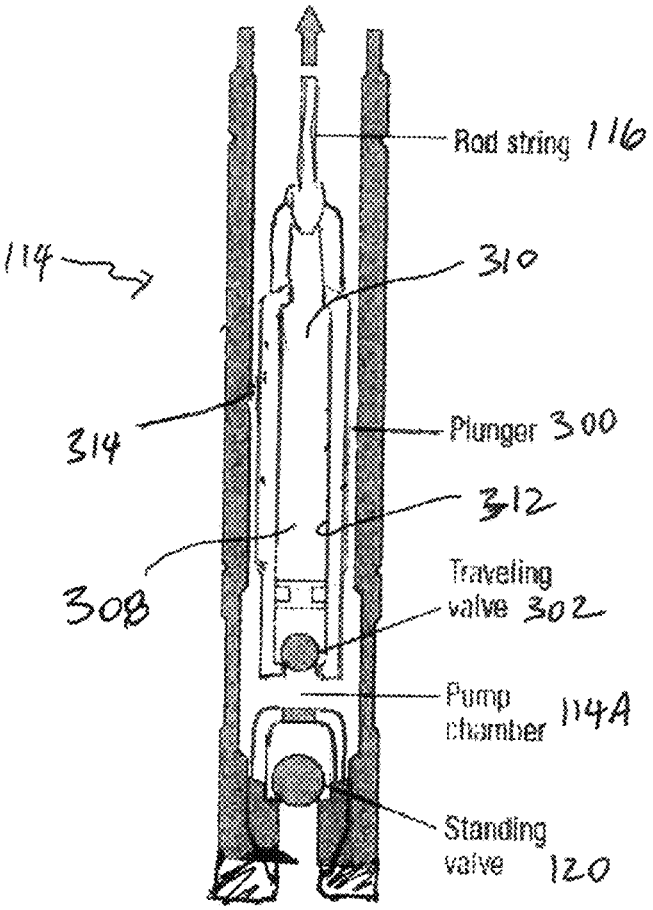
FIG. 1*c* is a schematic illustration of an embodiment of a downhole sucker rod pump.

Referring to FIG. 1*c*, the plunger 300 defines a flow passage 308 for conducting flow of reservoir fluid being displaced, during the down stroke, in an uphole direction, towards the wellhead 108. In this respect, the flow passage 308 is disposed in flow communication with the wellhead 108. The flow passage 308 is defined by a bore 310 within the plunger 300, and the bore 310 is defined by an internal surface 312 of the plunger 300.

Figure 2:
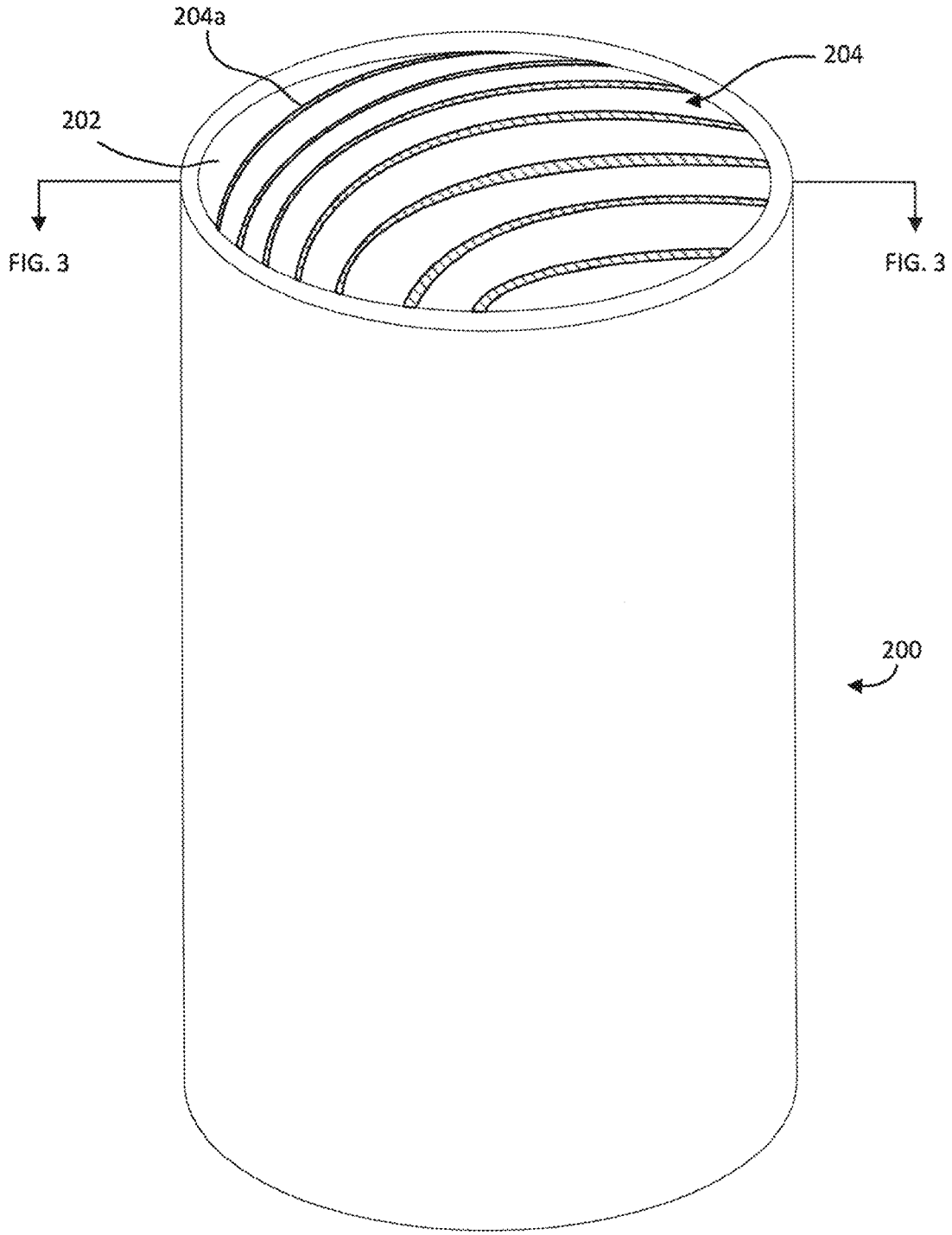
FIG. 2 is a schematic illustration of an embodiment of a housing in a downhole sucker rod pump system.
Figure 3:
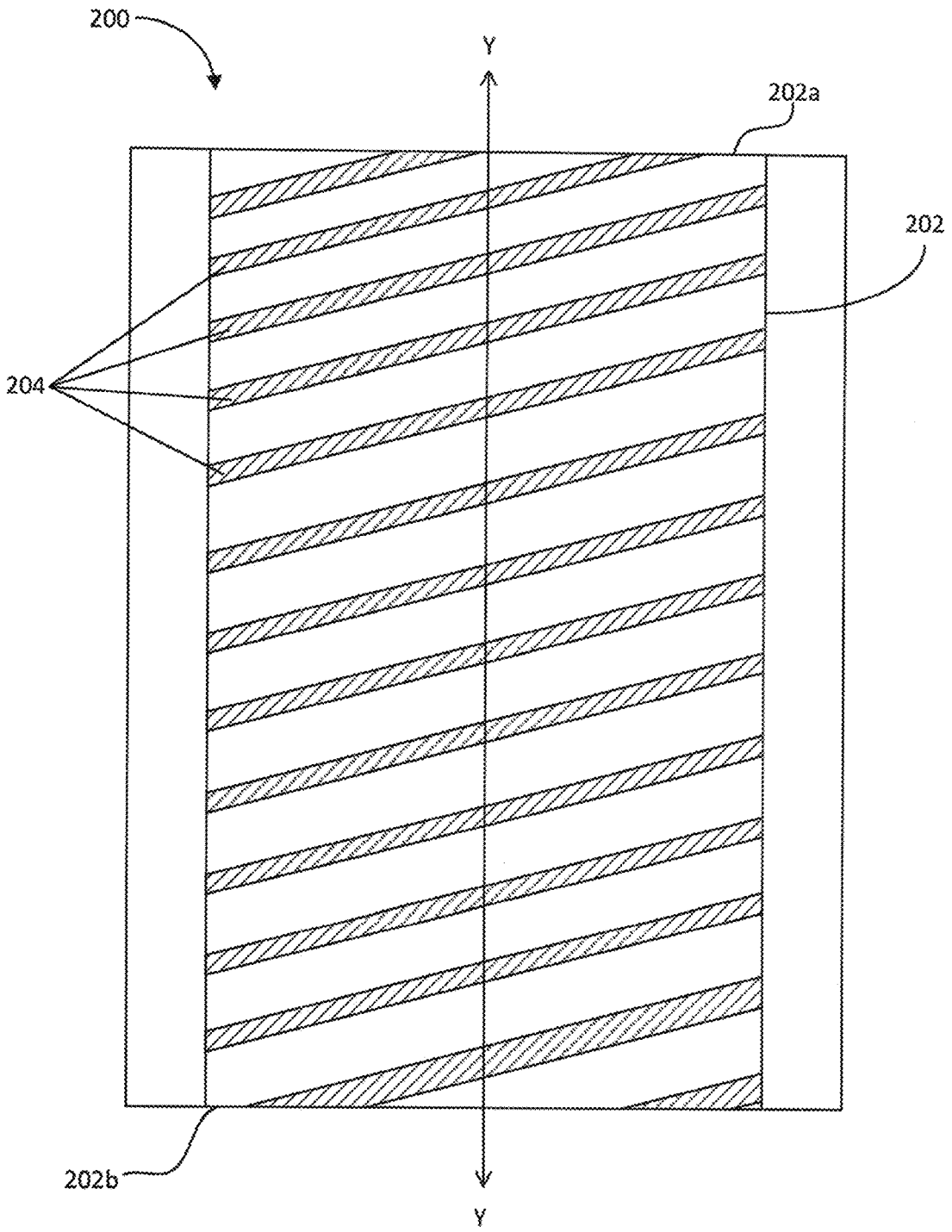
FIG. 3 is a schematic illustration of a cross-section of the embodiment of a housing in a downhole sucker rod pump system.
Figure 4:
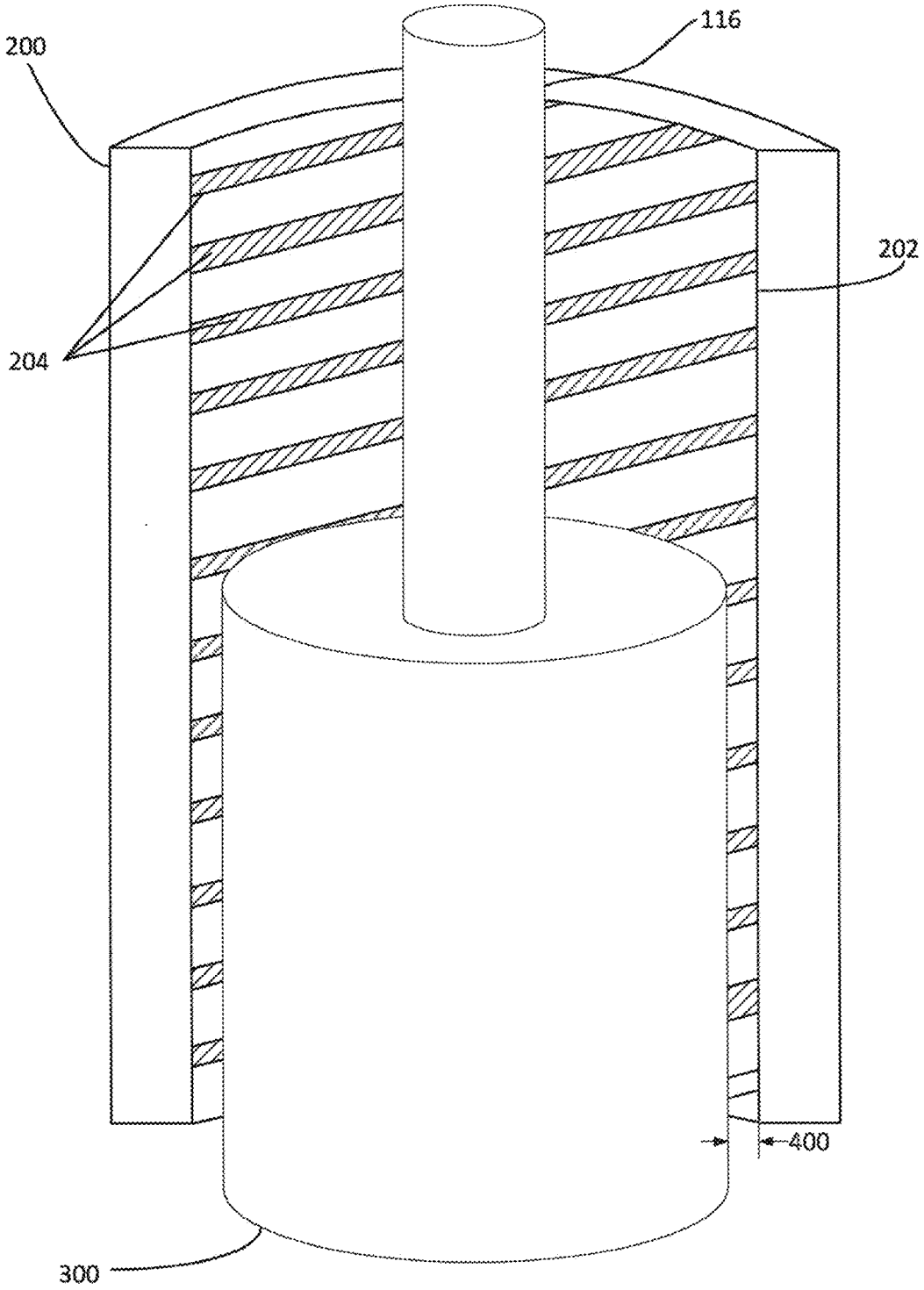
FIG. 4 is a schematic illustration of an embodiment of the housing and the plunger of a downhole sucker rod pump system.

Referring to FIGS. 2 to 4, there is provided a housing 200 for use in a downhole sucker rod pump system.

The housing 200 is shown in FIG. 2. In some embodiments, for example, the housing 200 is cylindrical in shape. In some embodiments, the housing 200 is made of thermoplastic material. The housing 200 has an inner surface 202 which defines a housing passage 201 within the housing 200. A helical groove configuration 204 is defined within the inner surface 202. In some embodiments, for example, the helical groove configuration 204 has a single, continuous helical groove 204*a*. In the embodiment depicted in FIGS. 2 to 4, the helical groove configuration 204 includes a plurality of continuous, helical grooves 204*a*. In some embodiments, the plurality of continuous, helical grooves 204*a* is a series of adjacent continuous, helical grooves 204*a*. In some embodiments, for example, the plurality of continuous, helical grooves is at least two continuous, helical grooves, such as, for example, at least three continuous, helical grooves, such as, for example, at least four continuous, helical grooves.

By providing the helical groove configuration 204 on the inner surface of the housing 200, removal of solid material from the clearance between the housing 200 and the plunger 300. In conventional downhole pumping system, the housing 200 would have no helical groove configuration 204 and would have a relatively smooth inner surface 202. Such conventional pumping systems have a clearance between the housing 200 and the plunger 300 that allows fluid to leak or slip (also referred to as fluid leakage or fluid slippage in the present disclosure) into the space between the plunger 300 and the inner surface 202 of the housing 200. Because the reservoir fluids also contain solid material, this fluid leakage causes the solid material to accumulate in the space defined by the clearance between the inner surface 202 of the housing 200 and the plunger 300 as the plunger 300 reciprocates. With solid material accumulating between the plunger 300 and the housing 200, the reciprocating movement of the plunger 300 can result in damage, such as grooving, of the plunger 300 from the reciprocating movement of the plunger rubbing against the solid material being trapped between plunger 300 and the housing 200. This clearance between the housing 200 and the plunger 300 is necessary as it both allows for pump lubrication and impacts pump efficiency. Increasing the clearance between housing 200 and the plunger 300 may help to mitigate issues with accumulated solid material, but will have a negative impact on pump efficiency.

By including the helical groove configuration 204 on the inner surface 202 of the housing 200, there is additional space provided between the housing 200 and the plunger 300, without increasing the clearance between the inner surface 202 of the housing and the plunger 300. The helical groove configuration 204 is configured such that fluid leakage can occur, in response to gravitational forces, via the helical groove configuration 204. In this regard, solid material-containing reservoir fluid, disposed above the plunger 300, is provided an alternative flowpath, via the helical configuration 204, for downwardly conveyance to below the plunger 300, rather than via the space between the inner surface 202 and the plunger 300. Accordingly, accumulation of solid material, between the plunger 300 and the housing 200, is mitigated, thereby mitigating potential damage to the plunger 300 (as described above).

FIG. 3 illustrates a cross-section view of the housing 200. In some embodiments, for example, the housing 200 defines a housing passage 201 having a central longitudinal axis Y. The central longitudinal axis Y can be vertical, however, depending on the orientation of the wellbore 102, the central longitudinal axis Y may be angled with respect to the surface 110. The central longitudinal axis Y is parallel to the reciprocating movement of the plunger 300.

In some embodiments, for example, each one of the helical grooves 204*a* is defined in only a portion of the inner surface 202. In other embodiments, for example, each one of the helical grooves 204*a*, independently, extend, continuously, from an upper end 202*a* of the inner surface 202 to a lower end 202*b* of the inner surface 202. Each one of the helical grooves 204*a*, independently, has a pitch from the reference plane normal to the central longitudinal axis Y. By inclining the helical grooves 204*a*, the helical grooves can wrap around the inner surface 202 to cover a length of the housing 200. The helical grooves 204*a* can rotate around the inner surface in a clockwise or counter-clockwise direction. When the helical groove configuration 204 includes a plurality of helical grooves 204*a*, in some embodiments, for example, each one of the helical grooves 204*a*, independently, rotates in the same rotational direction (i.e. clockwise or counter-clockwise).

In some embodiments, for example, each one of the helical grooves 204*a*, independently, has a pitch, measured from a reference plane to which the central longitudinal axis Y, of the housing passage 201, is normal, of greater than 30 degrees (such as, for example, greater than 40 degrees). In some embodiments, for example, each one of the helical grooves 204*a*, independently, has a pitch, measured from a reference plane to which the central longitudinal axis Y, of the housing passage 201, is normal, that is greater than 30 degrees and less than 65 degrees. In some embodiments, for example, the helical grooves 204*a* wind about the central longitudinal axis Y such that each one of the helical grooves 204*a*, independently, spans a distance of at least five (5) feet (such as, for example, seven (7) feet, such as, for example, at least nine (9) feet), as measured along the central longitudinal axis Y. In some embodiments, for example, the helical grooves 204*a* wind about the central longitudinal axis Y a total number of at least ten (10) times, such as, for example, at least 20 times.

The helical grooves 204*a* will be formed with dimensions that allow the solid material in the reservoir fluid to easily enter into the helical grooves 204*a*. In some embodiments, for example, the dimensions are such that the solid material is conducted via the helical grooves 204*a*, as opposed to the clearance between the plunger 300 and the inner surface 202.

Solid material in the reservoir fluid may vary in size depending on a variety of factors in the well. In an embodiment, the solid material is comprised of solid particulate material. In a further embodiment, at least 90% of the solid particulate material has a particle size that is greater than 20 mesh.

Figure 5:
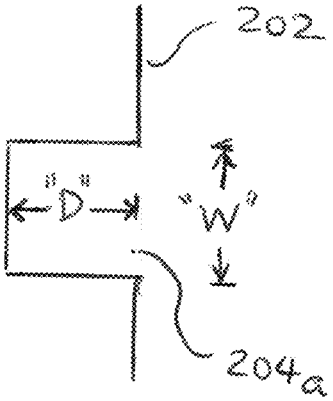
FIG. 5 is a schematic illustration of a groove of a groove configuration of an embodiment of a housing in a downhole sucker rod pump system, illustrating the width "W" and depth "D" of the groove.

Referring to FIG. 5, in some embodiments, for example, each one of the helical grooves 204*a*, independently, has a minimum groove width "W", and the minimum groove width "W" is at least 0.5 millimetres. In some of these embodiments, for example, each one of the helical grooves 204*a*, independently, has a maximum groove width "W", and the maximum groove width "W" is no more than three (3) millimetres.

Referring again to FIG. 5, in some embodiments, for example, each one of the helical grooves 204*a*, independently, has a minimum groove depth "D", and the minimum groove depth "D" is at least than 0.1 millimetres (such as, for example, greater than 0.2 millimetres). In some of these embodiments, for example, each one of the helical grooves 204*a*, independently, has a maximum groove depth "D", and the maximum groove depth "D" is no more than 1.0 millimetres.

In some embodiments, for example, each one of the helical grooves 204*a*, independently, has a minimum groove length of at least 12 feet, as measured along the central longitudinal axis of the groove 204*a*.

FIG. 4 depicts the housing 200 and the plunger 300, cooperatively engaged such that the plunger 300 can reciprocate in the housing 200. The plunger 300 is caused to reciprocate by the surface equipment, such that the plunger travels to a maximum plunger depth (or lowermost position) 306 on the downstroke and a minimum plunger depth (or uppermost position) 304 on the upstroke. In this respect, the plunger 300 reciprocates between the uppermost position 304 and the lowermost position 306. The uppermost position 304 defines the upper extent of travel of the plunger 300, and the lowermost position 306 defines the lower extent of travel of the plunger 300.

Figure 6A:
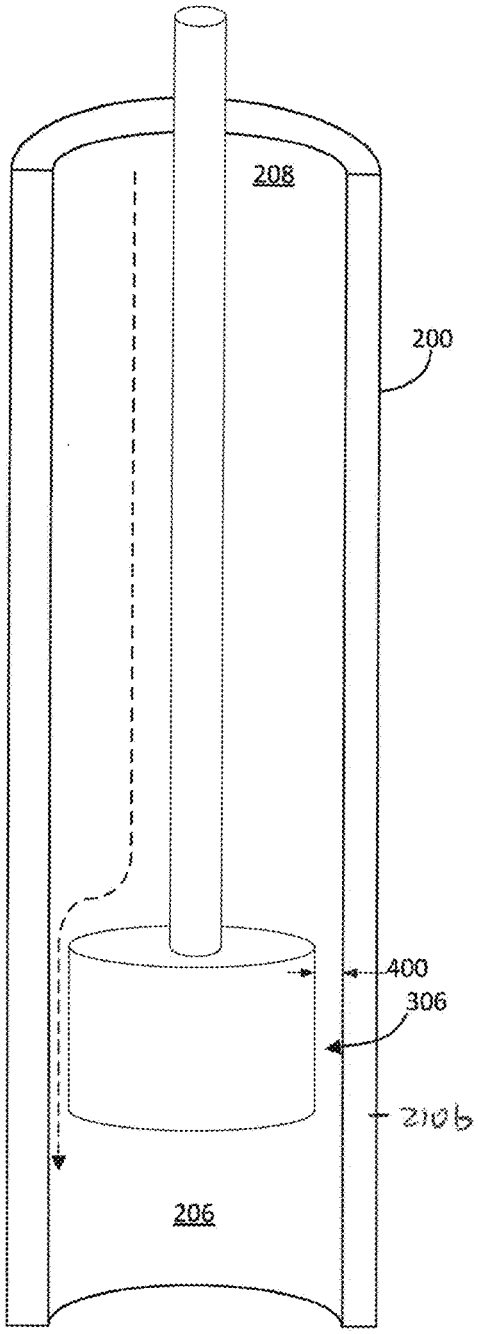
FIG. 6*a* is a schematic diagram of the plunger and housing apparatus with the plunger in the lowermost position.
Figure 6B:
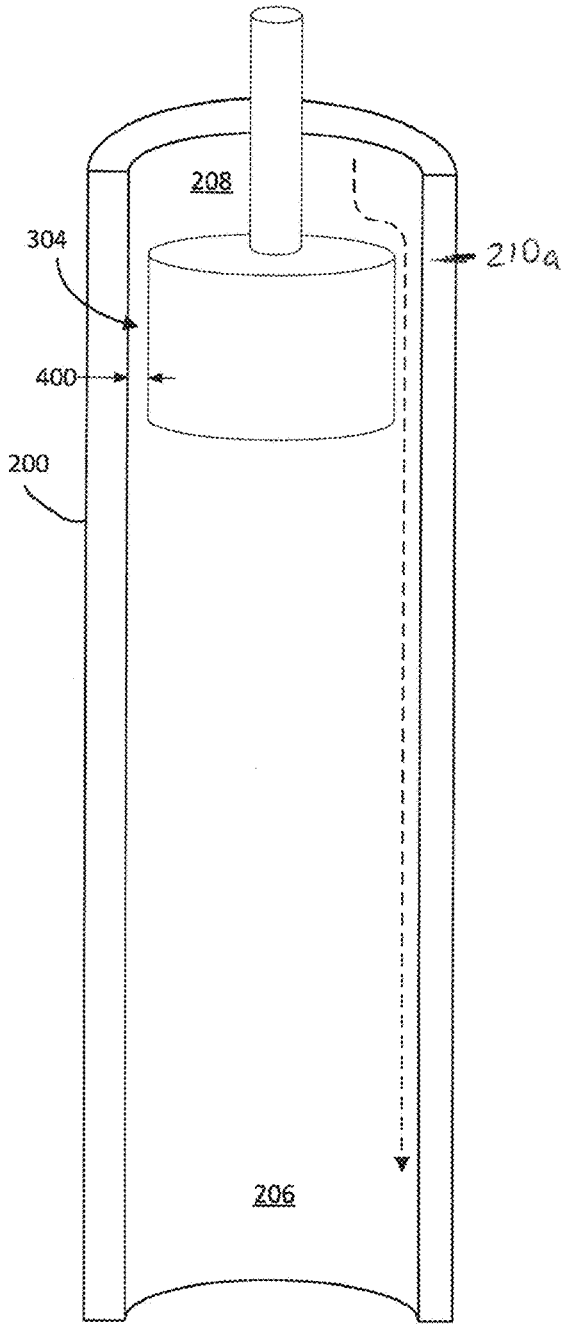
FIG. 6*b* is a schematic diagram of the plunger and housing apparatus with the plunger in the uppermost position.

FIGS. 6*a* and 6*b* illustrate the reciprocating movement of the plunger inside the housing 200, with the plunger 300 at the lowermost position 306 in FIG. 6*a* (i.e. at the completion of the downstroke) and the plunger 300 at the uppermost position 304 in FIG. 6*b* (i.e. at the completion of the upstroke). The helical groove configuration 204 is removed from FIGS. 6*a* and 6*b*, for clarity.

The housing 200 has an upper space 208 that is located above the plunger 300 in the housing 200 and contains reservoir fluid that will either leak downwards or be pumped towards the surface 110. The housing also has a lower space 206 that is located below the plunger 300 in the housing 200 and contains reservoir fluid that has leaked downwards, or that has been received from the reservoir fluid-receiving zone 118.

In some embodiments, the plunger 300 may not traverse the entire length of the housing 200. In such an embodiment, the housing 200 has a plunger-traversable section 212 that spans a portion of the housing 200 in which the plunger traverses. The plunger-traversable section 212 is defined by the portion of the housing 200 between the lower and uppermost positions 306, 304 of the plunger 300, as depicted in FIGS. 6*a* and 6*b*, and, in this respect, is defined by the portion of the housing 200 between an upper extent 210*a* and a lower extent 210*b*, such that the plunger-traversable section 212 extends downwardly from the upper extent 210*a* (FIG. 6*b*) to the lower extent 210*b* (FIG. 6*a*).

As the plunger 300 traverses the plunger-traversable section 212 of the housing 200, there is a gap or clearance 400 between the plunger 300 and the inner surface 204. As described above, the clearance 400 is necessary to allow for lubrication of the plunger 300, but does not need to be large enough to accommodate the solid material in the reservoir fluid. The space around the plunger defined by clearance 400 is in fluid communication with the upper space 208 in the housing 200. The upper space 208 of the housing 200 is located above the plunger 300 and allows reservoir fluid to slip downwards into the space defined by clearance 400. The space around the plunger defined by clearance 400 is also in fluid communication with the lower space 206 in the housing 200. These upper and lower spaces 206, 208 being in fluid communication with the space around the plunger defined by the clearance 400 ensures that reservoir fluid can lubricate the plunger 300 while also allowing reservoir fluid to leak downwards from the upper space 208 to the lower space 206 to re-enter the pumping system. In this regard, in some embodiments, the clearance 400 between the plunger 300 and the inner surface 204 has a minimum spacing, and the minimum spacing is at least 3/1000 of an inch (such as, for example greater than 4/1000 of an inch). In some of these embodiments, for example, the clearance 400 between the plunger 300 and the inner surface 204 has a maximum spacing of no greater than 12/1000 of an inch (such as, for example, no greater than 10/1000 of an inch). Flow of reservoir fluid for lubricating the plunger 300 will follow the directions indicated in dashed lines in FIGS. 5*a* and 5*b*.

The upper and lower spaces 208, 206 of the housing 200 are also in fluid communication with the helical groove configuration 204 (not shown in FIGS. 5*a* and 5*b*). This allows reservoir fluid with solid material to enter to helical groove configuration 204, such that the solid material is conveyed downwards towards the lower space. This allows the solid material to accumulate below the plunger 300, rather than accumulate between the plunger 300 and the housing 200. Reservoir fluid containing solid material will flow from the upper space 208, into the helical groove configuration 204 (and thus away from the plunger 300), down the helical groove configuration 204 and into the lower space 206.

In some embodiments, at least a portion of the helical groove configuration 204 is located within the plunger-traversable section 212 of the housing 200 and defines a plunger traversable groove configuration. In some embodiments, for example, the helical groove configuration 204 extends above the plunger-traversable section 212 of the housing 200. In some embodiments, for example, the helical groove configuration 204 extends from above the plunger-traversable section 212, through the plunger-traversable section 212, and to below the plunger-traversable section 212.

Figure 7:
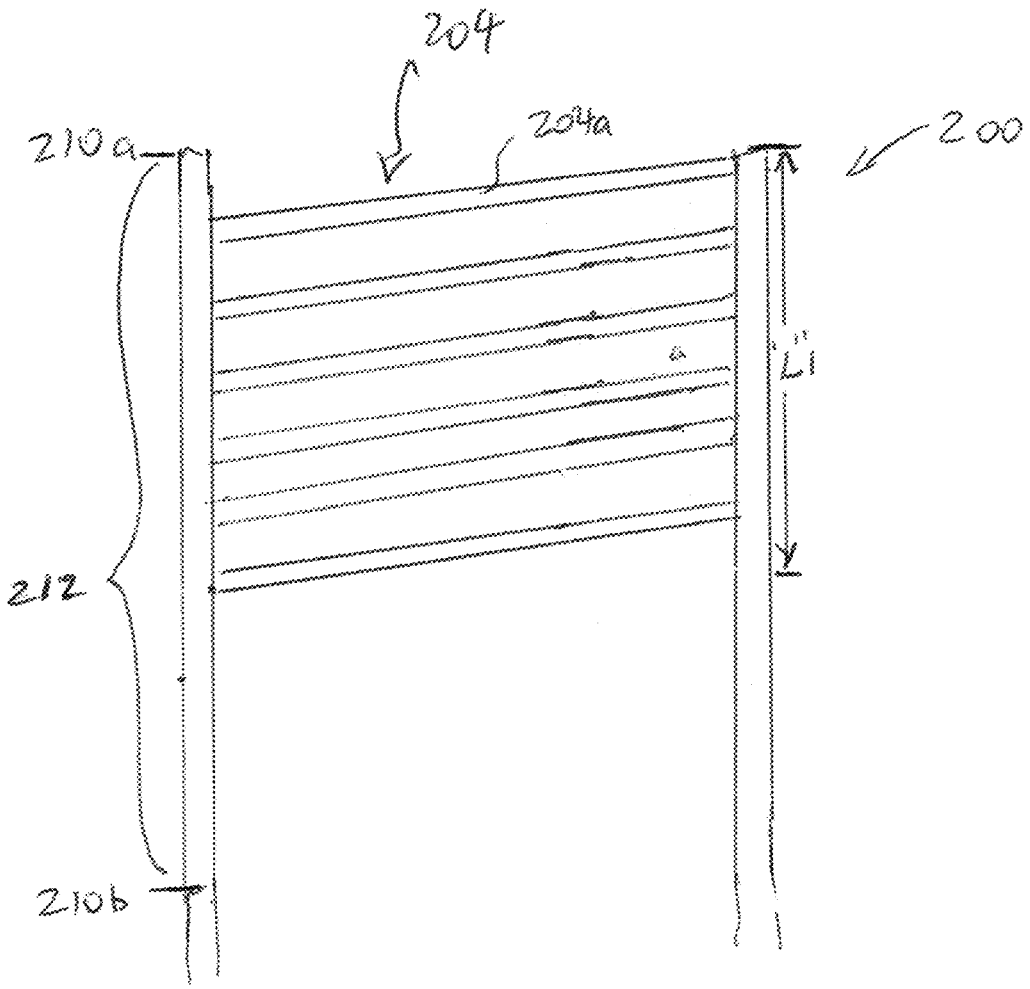
FIG. 7 is a schematic illustration of a cross-section of another embodiment of a housing in a downhole sucker rod pump system whose helical configuration is defined by a single helical recess.

Referring to FIG. 7, in some embodiments, for example, the helical groove configuration 204 is disposed above a lowermost ⅓ of the plunger-traversable section 212 only. In this respect, in such embodiments, the plunger traversable groove configuration is disposed above a lowermost ⅓ of the plunger-traversable section 212 only.

Figure 8:
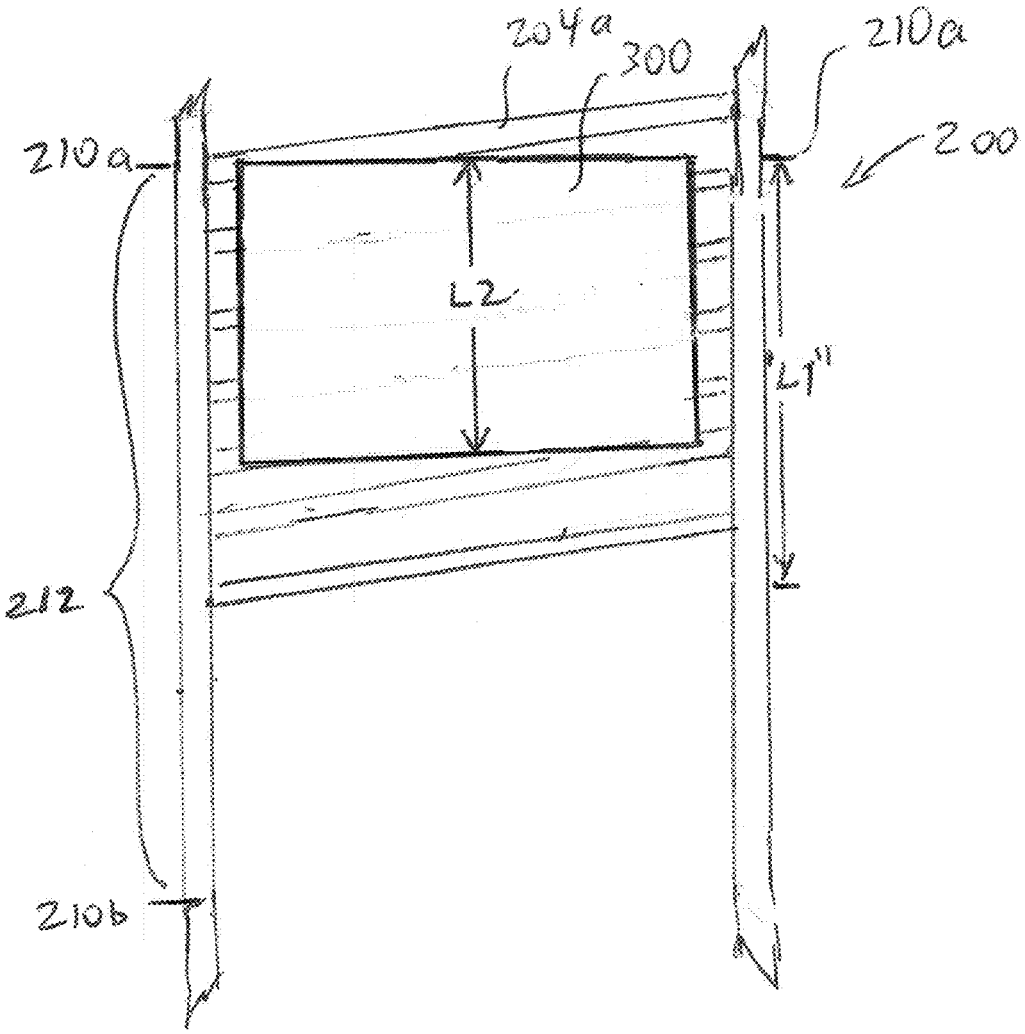
FIG. 8 is identical to FIG. 7, and additionally illustrates a plunger emplaced at an upper extent of its travel.

In some embodiments, for example, the helical groove configuration 204 and the plunger 300 are co-operatively configured such that, while the plunger 300 is emplaced at the uppermost position 304, the helical groove configuration 204 is disposed in flow communication with the upper space 208 (i.e. the space above the plunger 300), and the flow communication between the helical groove configuration 204 and the upper space 208 is established in the absence of flow communication via the clearance 400. In some of these embodiments, for example, the helical groove configuration 204 merges with the upper space 208. In this respect, in such embodiments, while the plunger is emplaced at the uppermost position 304, flow communication, via the clearance 400 only, is avoided in establishing flow communication between the upper space 208 and the helical groove configuration, such that while the plunger is emplaced at the uppermost position 304, conveyance of solid material, via the clearance 400, is abated while the solid material is being conveyed from the upper space 208 to the lower space 206 via the helical groove configuration. In some of these embodiments, for example, the helical groove configuration and the plunger 300 are co-operatively configured such that, while the plunger 300 is emplaced at the uppermost position 304, the helical configuration extends downwardly from at least the upper extent 210*a* of, or above, the plunger traversable section 212 to below the plunger 300. In some of these embodiments, for example, the helical groove configuration 204 and the plunger 300 are co-operatively configured such that, while the plunger 300 is emplaced at the uppermost position 304, the helical groove configuration extends downwardly from above the upper extent 210*a* of the plunger-traversable section 212 (i.e. above the plunger 300) to below the plunger 300 (see FIG. 8). In some of these embodiments, for example, the helical groove configuration 204 wraps around the inner surface 202 to span a length ("L1") of the housing 200 (see FIG. 7), extending downwardly from the upper extent 210A of the plunger-traversable section 212, that exceeds the length of the plunger 300. In some of these embodiments, for example, the ratio of the length "L1" of the housing 200, extending downwardly from the upper extent 210A of the plunger-traversable section 212, that is spanned by the helical groove configuration, to the length "L2" of the plunger is at least 1.25 to 1, such as for example, 1.5 to 1, such as, for example, at least 1.75 to 1, such as, for example, 2 to 1. In some embodiments, for example, the length of the plunger-traversable section 212, that is spanned by the helical groove configuration, is at least five (5) feet, such as, for example, at least seven (7) feet, such as, for example, at least nine (9) feet.

In this regard, the combination of the production string 122, the upper space 208, lower space 206, the helical groove configuration 204, and the space around the plunger defined by the clearance 400 create a flow passage for reservoir fluid and solid material. Although a large portion of the reservoir fluid within the production assembly 112 will be pumped to the surface 110, a portion of the reservoir fluid containing sold material can leak or slip downwards from the upper space 208, through the helical groove configuration 204 and into the lower space 206. Additionally, a portion of the reservoir fluid with little or no solid material can leak or slip downwards from the upper space 208, around the plunger 300 through the space defined by clearance 400 and into the lower space 206 to lubricate the plunger 300.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A downhole sucker rod pump comprising:

a plunger;

a housing that defines a passage-defining surface, wherein the passage-defining surface includes an inner-surface configuration and a recess-defining surface, wherein the recess-defining surface is recessed from the inner surface configuration and defines a recess; and a housing passage defined by the passage-defining surface;

wherein:

the plunger and the housing are co-operatively configured such that the plunger is operable for reciprocating movement through the housing passage, with effect that:

the plunger travels through the housing passage and traverses a plunger-traversable section of the passage-defining surface of the housing, wherein the travel, of the plunger, is characterized by an upper extent of travel of the plunger, at which the plunger becomes emplaced in an uppermost position, and is also characterized by a lower extent of travel of the plunger, at which the plunger becomes emplaced in a lowermost position;

a clearance is defined between the plunger and the inner surface configuration of the housing, such that flow communication is established across the plunger via the clearance; and at least a portion of the recess extends from the plunger-traversable section to below the lowermost position of the plunger; and the plunger and the housing are further co-operatively configured such that while the downhole sucker rod is emplaced within a wellbore, in flow communication with a reservoir within which is disposed a solids-comprising reservoir fluid material, and reciprocating movement, of the plunger, is being motivated:

the solids-comprising reservoir fluid material is displaced in an uphole direction, to an uphole space of the housing passage that is disposed uphole relative to the uppermost position of the plunger, a solid material separates from the solids-comprising reservoir fluid in response to gravity separation and the separated solid material is conducted via the housing passage to the clearance, and, after being received within the clearance, the separated solid material is conducted via the clearance to the recess, and, after being received within the recess, the separated solid material is conducted via the recess to a downhole space, of the housing passage, that is disposed downhole relative to the lowermost position of the plunger.

2. The pump as claimed in claim 1;

wherein:

the clearance has a maximum spacing of no more than 0.0120 of an inch.

3. The pump as claimed in claim 1;

wherein:

the solid material, of the solids-comprising reservoir fluid material, is comprised of solid particulate material, and at least 90% of the solid particulate material has a particle size that is greater than 20 mesh.

4. The pump as claimed in claim 1;
wherein:
the housing includes a barrel which defines at least a portion of the plunger-traversable recess.

5. The pump as claimed in claim 1;
wherein:
the recess is a helical groove.

6. The pump as claimed in claim 5;
wherein:
the helical groove has a minimum groove depth of at least 0.1 millimetres.

7. The pump as claimed in claim 5;
wherein:
the helical groove has a minimum groove width of at least 0.5 millimetres.

8. The pump as claimed in claim 5;
wherein:
the helical groove has a maximum groove width of no more than 3 millimetres.

9. The pump as claimed in claim 5;
wherein:
the reciprocating movement of the plunger is effectuated through a housing passage, defined by the inner surface of the housing, and the housing passage includes a central longitudinal axis; and
the helical groove has a pitch, measured from a reference plane to which the central longitudinal axis, of the housing passage, is normal, of greater than 30 degrees.

10. The pump as claimed in claim 9;
wherein:
the helical groove has a pitch that is less than 65 degrees from the reference plane.

11. The pump as claimed in claim 9;
wherein:
the helical groove has a pitch, measured from a reference plane to which the central longitudinal axis, of the housing passage, is normal, that is less than 65 degrees.

12. The pump as claimed in claim 11;
wherein:
the helical groove winds about the central longitudinal axis of the housing passage; and
the helical groove spans a distance, measured along the central longitudinal axis of the housing passage, of at least 10 feet.

13. The pump as claimed in claim 9;
wherein:
the helical groove winds about the central longitudinal axis of the housing passage; and
the helical groove spans a distance, measured along the central longitudinal axis of the housing passage, of at least 10 feet.

14. The pump as claimed in claim 13;
wherein:
a length of the housing passage, measured along the central longitudinal axis of the housing passage, is greater than the distance spanned by the helical groove.

15. The pump as claimed in claim 9
wherein:
the helical groove winds about the central longitudinal axis of the housing passage a total number of at least 20 times.

16. The pump as claimed in claim 5;
wherein:
the helical groove has a central longitudinal axis, and a length of the helical groove, measured along the central longitudinal axis, is at least 12 feet.

17. A downhole rod pump comprising:
a plunger;
a housing that defines a passage-defining surface, wherein the passage-defining surface includes an inner surface configuration and a recess-defining surface, wherein the recess-defining surface is recessed from the inner surface configuration and defines a recess; and
a housing passage defined by the passage-defining surface;
wherein:
the plunger and the housing are co-operatively configured such that the plunger is operable for reciprocating movement through the housing passage, with effect that:
the plunger travels through the housing passage and traverses a plunger-traversable section of the passage-defining surface of the housing, wherein the travel, of the plunger, is characterized by an upper extent of travel of the plunger, at which the plunger becomes emplaced in an uppermost position, and is also characterized by a lower extent of travel of the plunger, at which the plunger becomes emplaced in a lowermost position; and
a clearance is defined between the plunger and the inner surface configuration of the housing, such that flow communication is established across the plunger via the clearance; and
the recess extends from above the uppermost position of the plunger to at least the plunger-traversable section;
the plunger and the housing are further co-operatively configured such that, while the downhole sucker rod is emplaced within a wellbore, in flow communication with a reservoir within which is disposed a solids-comprising reservoir fluid material, and reciprocating movement, of the plunger, is being motivated:
the solids-comprising reservoir fluid material is displaced in an uphole direction, to an uphole space of the housing passage that is disposed uphole relative to the uppermost position of the plunger, a solid material separates from the solids-comprising reservoir fluid in response to gravity separation and is conducted downhole via the housing passage to the recess, and, after being received within the recess, the separated solid material is conducted via the recess to at least the plunger-traversable section.

18. The downhole rod pump as claimed in claim 17;
wherein:
the recess spans a length L1 that exceeds a length L2 of the plunger.

19. The downhole rod pump as claimed in claim 18;
wherein:
a ratio of the length L1 to the length L2 is at least 1.25 to 1.

20. The downhole sucker rod pump as claimed in claim 17;
wherein:
the extension of the recess is an extension to above a lowermost ⅓ of the plunger-traversable section.

21. The downhole sucker-rod pump as claimed in claim 17;
wherein:
the extension of the recess, from above the uppermost position of the plunger to at least the plunger-traversable section, is an extension to below the lowermost position of the plunger, such that the conducting of the separated solid material, via the recess, to at least the plunger-traversable section, for which the plunger and the housing are co-operatively configured while: (i) the downhole sucker rod is emplaced within a wellbore in flow communication with a reservoir within which is disposed a solids-comprising reservoir fluid material, and (ii) reciprocating movement, of the plunger, is being motivated, is a conducting of the separated solid material to a downhole space, of the housing passage, that is disposed downhole relative to the lowermost position of the plunger.

* * * * *